US012004667B1

(12) United States Patent
Lord

(10) Patent No.: US 12,004,667 B1
(45) Date of Patent: Jun. 11, 2024

(54) STEMWARE RETENTION DEVICE

(71) Applicant: John Lord, Dana Point, CA (US)

(72) Inventor: John Lord, Dana Point, CA (US)

( * ) Notice: Subject to any disclaimer, the term of this patent is extended or adjusted under 35 U.S.C. 154(b) by 0 days.

(21) Appl. No.: 18/111,954

(22) Filed: Feb. 21, 2023

(51) Int. Cl.

| | |
|---|---|
| ***A47G 23/02*** | (2006.01) |
| ***A47B 37/04*** | (2006.01) |
| ***A47G 23/06*** | (2006.01) |
| *A47G 23/03* | (2006.01) |

(52) U.S. Cl.
CPC ..... *A47G 23/0208* (2013.01); *A47B 37/04* (2013.01); *A47G 23/0641* (2013.01); *A47G 23/03* (2013.01); *A47G 23/06* (2013.01)

(58) Field of Classification Search
CPC ..... A47G 23/0208; A47G 23/03; A47G 23/0641; A47G 23/02; A47G 23/0225; A47G 23/0216; A47G 23/0241; A47G 2023/0291; A47G 23/06; A47G 23/0608; A47G 23/0616; A47G 23/0625; A47G 23/0633; A47B 37/04; A47B 73/00; A47B 73/004; A47B 73/008; A47F 7/28
See application file for complete search history.

(56) References Cited

U.S. PATENT DOCUMENTS

| | | | | | |
|---|---|---|---|---|---|
| 353,554 | A * | 11/1886 | Godfrey | A47F 5/0037 | 211/77 |
| 774,479 | A * | 11/1904 | Lange | A47G 23/0208 | 269/254 R |
| 2,142,019 | A * | 12/1938 | Warner | A47J 31/44 | 248/68.1 |
| 3,672,514 | A | 6/1972 | Tucker | | |
| 4,947,991 | A * | 8/1990 | Snell | A47B 13/16 | 206/427 |
| 5,335,803 | A * | 8/1994 | O'Brien | A47B 13/14 | 211/163 |
| 6,126,256 | A * | 10/2000 | Does, II | A47B 81/04 | 312/351 |
| 6,571,403 | B2 * | 6/2003 | Wheaton | E04H 4/14 | 4/496 |
| 7,789,459 | B1 * | 9/2010 | Rodriguez | A47B 97/00 | 297/158.3 |
| 8,640,894 | B1 * | 2/2014 | Cronin | A47B 97/00 | 211/205 |
| 9,028,288 | B2 * | 5/2015 | Lovett | B63B 22/24 | 441/32 |
| D781,658 | S | 3/2017 | Chiorazzi | | |

(Continued)

FOREIGN PATENT DOCUMENTS

WO WO2015079234 6/2015

*Primary Examiner* — Devin K Barnett

(57) ABSTRACT

A stemware retention device for preventing tipping of stemware includes a first plate, which is substantially planar. Each slot of a set of slots extends into the first plate from its perimeter. A spacing element, which is attached to and which extends from a lower face of the first plate, supports the first plate above a substantially horizontal surface, such as a tabletop. A plurality of panels is attached to from the first plate's lower face so that each slot is bracketed by a pair of panels. Each panel extends from the first plate to proximate to the substantially horizontal surface. The panels are resiliently flexible so that each pair of panels can engage a base of an article of stemware as its stem is inserted into a respective slot. Thus, tipping of the article of stemware relative to the substantially horizontal surface is inhibited.

8 Claims, 3 Drawing Sheets

(56) References Cited

U.S. PATENT DOCUMENTS 9,801,484 B2 10/2017 Dodd
D817,728 S * 5/2018 Brown ..... D7/701
9,980,589 B2 5/2018 Piccinini
10,064,510 B1 * 9/2018 Yablon ..... A47G 23/0208
D880,964 S * 4/2020 Wang ..... D7/701
D895,371 S * 9/2020 Brown ..... D7/554.2
10,925,360 B1 * 2/2021 Schwiebert ..... A47C 13/00
D911,759 S * 3/2021 Repp ..... D6/707.19
11,266,258 B1 3/2022 Moon
2004/0129184 A1 * 7/2004 Kraker ..... E04H 12/2223 108/50.12
2006/0113263 A1 * 6/2006 Kratochvil ..... A47G 23/0208 211/85.29
2006/0124157 A1 * 6/2006 Bayour ..... E05G 1/005 126/600
2006/0169656 A1 8/2006 Belden
2007/0062939 A1 * 3/2007 Davis ..... A47G 19/065 220/23.2
2007/0236060 A1 * 10/2007 Switzer ..... A47C 15/006 297/240
2008/0264822 A1 * 10/2008 Faiola ..... A47G 23/0641 206/557
2009/0189035 A1 * 7/2009 Gambill ..... A45B 23/00 248/218.4
2010/0209662 A1 * 8/2010 Slade ..... A47G 23/02 428/131
2011/0278248 A1 * 11/2011 Pron ..... A45B 3/00 29/428
2014/0339115 A1 * 11/2014 Chiorazzi ..... A47G 23/0641 206/426
2016/0106187 A1 * 4/2016 Sloan ..... A45B 23/00 135/16
2017/0071383 A1 * 3/2017 Cook ..... A47G 23/0216
2017/0086603 A1 * 3/2017 Sortino ..... F16B 1/00
2021/0093113 A1 * 4/2021 Brown ..... A47G 23/0208
2023/0380584 A1 * 11/2023 Termeer ..... A47B 37/04

* cited by examiner

STEMWARE RETENTION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to retention devices and more particularly pertains to a new retention device for preventing tipping of stemware. The present invention discloses a retention device for holding stemware in place upon a tabletop so that the stemware does not tip over.

(2) Description of Related Art Including Information Disclosed Under 37 CFR 1.97 and 1.98

The prior art relates to retention devices, which may comprise handheld food plates in which slots are positioned for insertion of stems of stemware, such that bowls of the stemware engage the plates, stemware carrying cases and display stands comprising slotted plates, and stabilizing devices that are attachable to stemware. What is lacking in the prior art is a retention device comprising a slotted plate having resilient panels bracketing each slot, wherein the resilient panels engage a base of an article of stemware upon insertion of its stem into the slot.

BRIEF SUMMARY OF THE INVENTION

An embodiment of the disclosure meets the needs presented above by generally comprising a first plate, which is substantially planar. Each slot of a set of slots extends into the first plate from a perimeter of the first plate. A spacing element is attached to and extends from a lower face of the first plate. The spacing element is configured to support the first plate above a substantially horizontal surface, such as a tabletop. A plurality of panels is attached to the lower face of the first plate so that each slot is bracketed by a pair of panels. Each panel extends from the first plate to proximate to the substantially horizontal surface. The panels are resiliently flexible so that each pair of panels is configured to engage a base of a respective article of stemware as a stem of the respective article of stemware is inserted into a respective slot. Thus, tipping of the respective article of stemware relative to the substantially horizontal surface is inhibited.

Another embodiment of the disclosure includes a stemware retention system, which comprises an article of stemware and a table, upon which a stemware retention device, as described in the disclosure above, is positioned. The article of stemware comprises a stem that extends from a base, with the stem being inserted into a respective slot of the stemware retention device and the base being engaged to a respective pair of panels of the stemware retention device. Thus, tipping of the article of stemware relative to a top of the table is inhibited.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
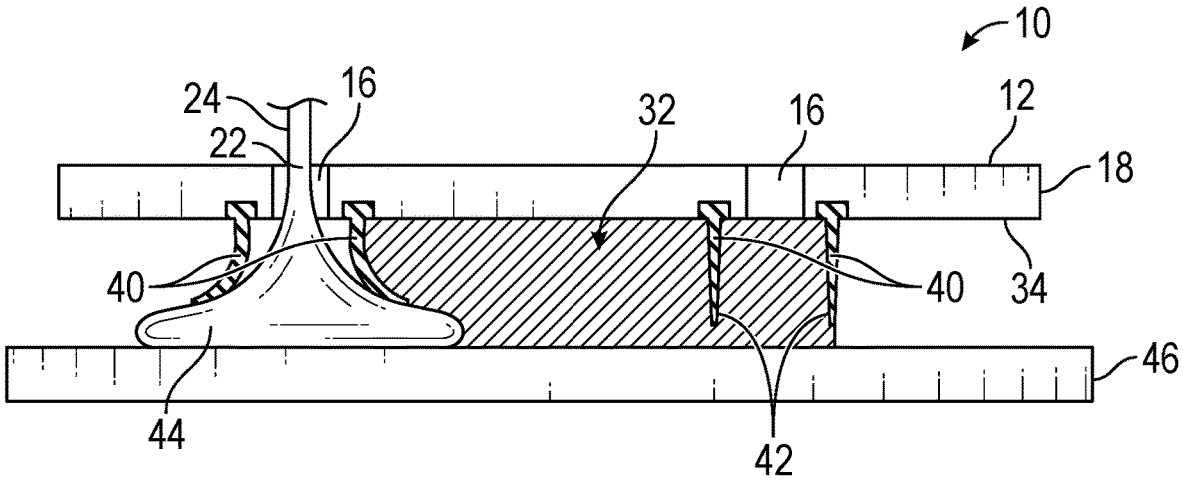
FIG. 1 is a front view of a stemware retention device according to an embodiment of the disclosure.

With reference now to the drawings, and in particular to FIGS. 1 through 5 thereof, a new retention device embodying the principles and concepts of an embodiment of the disclosure and generally designated by the reference numeral 10 will be described.

Figure 2:
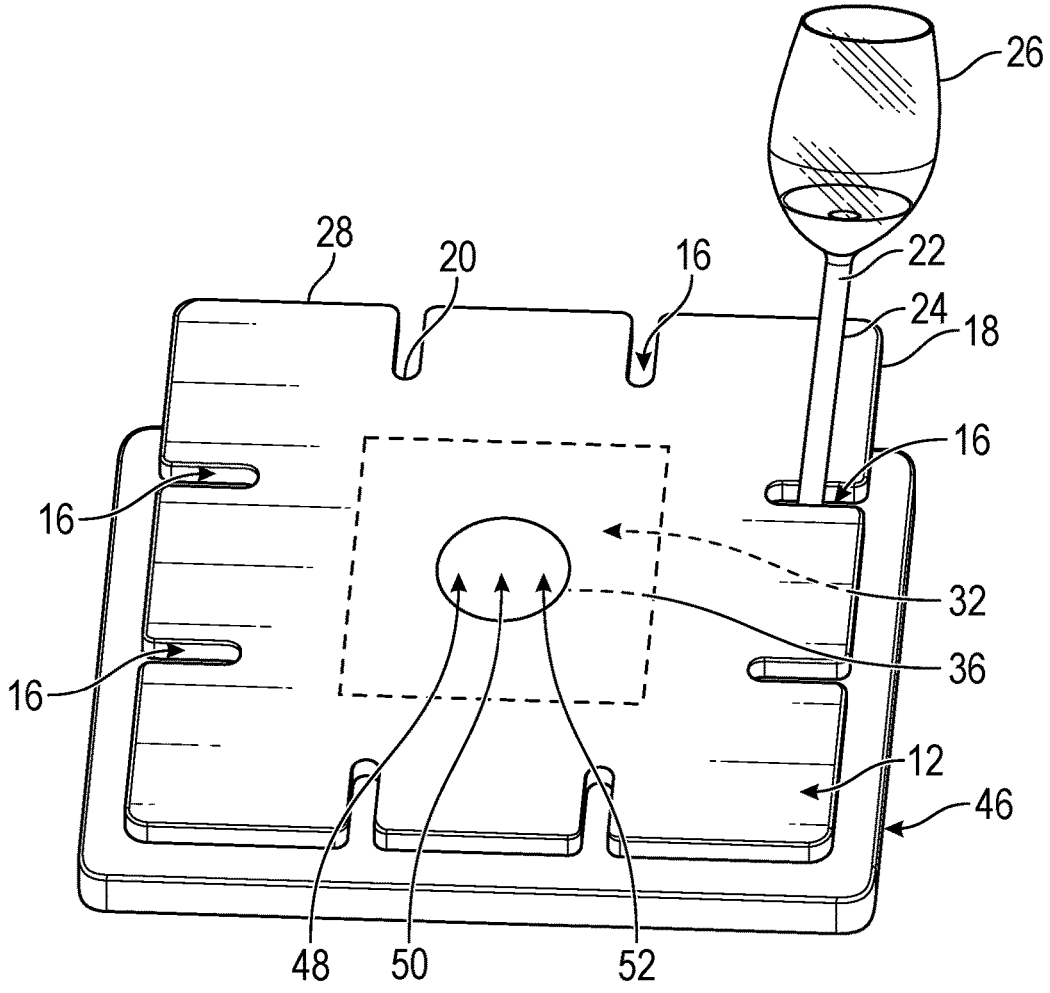
FIG. 2 is an isometric perspective view of an embodiment of the disclosure.
Figure 3:
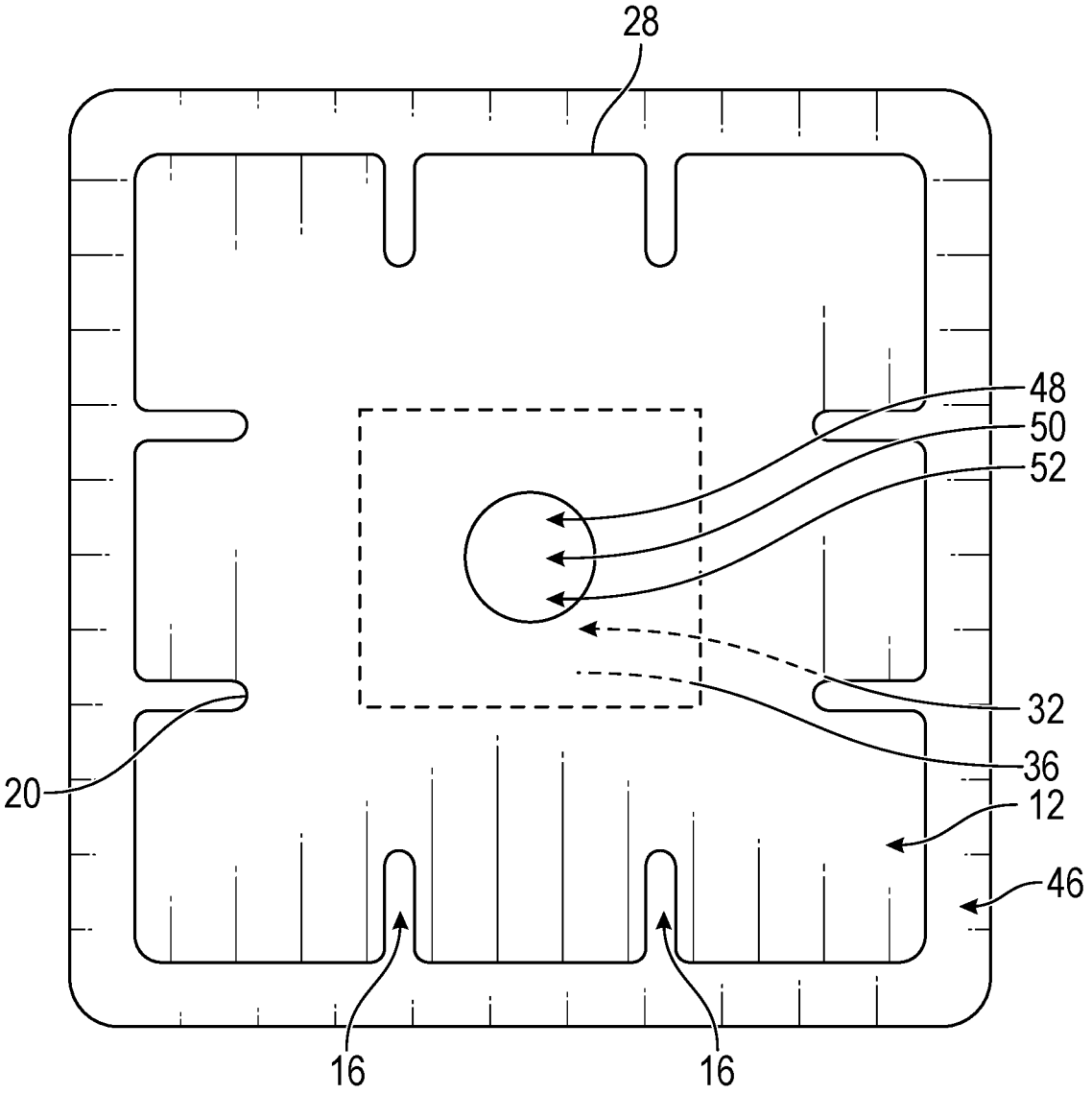
FIG. 3 is a top view of an embodiment of the disclosure.
Figure 4:
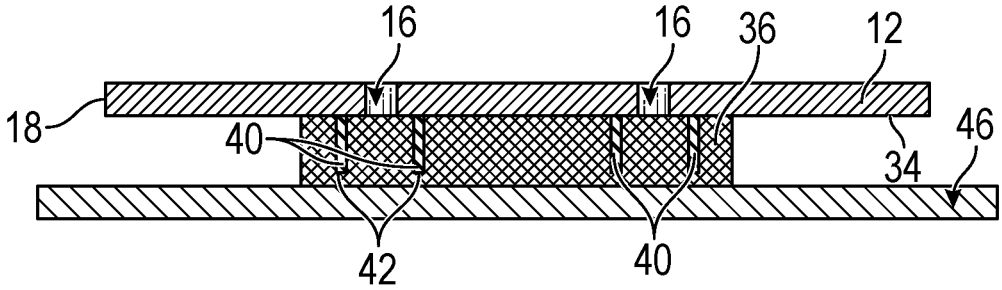
FIG. 4 is a cross-sectional view of an embodiment of the disclosure.
Figure 5:
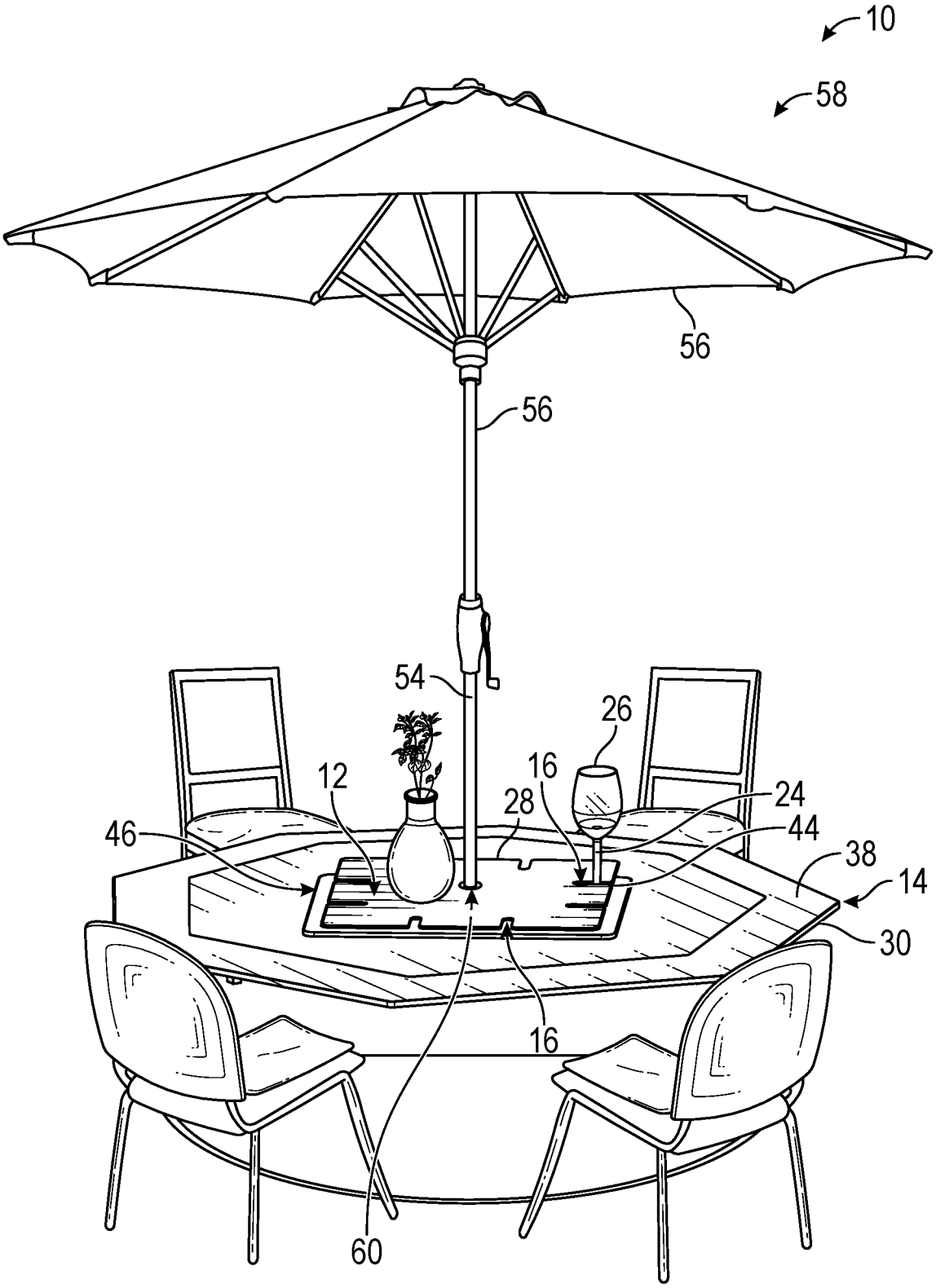
FIG. 5 is an in-use view of an embodiment of the disclosure.

As best illustrated in FIGS. 1 through 5, the stemware retention device 10 generally comprises a first plate 12, which is substantially planar. The first plate 12 is one of rectangular, square, hexagonal, octagonal, circular, ovoid, or the like. As will become apparent, how the first plate 12 is shaped is not critical to its function, but utility of the stemware retention device 10 may be increased with the first plate 12 being shaped complementarily to a table 14 with which the stemware retention device 10 is being used. The present invention anticipates the stemware retention device 10 being designed to complement tables 14 of a variety of configurations and which are designed for seating a variety of numbers of individuals. As shown in FIGS. 2 and 3, the first plate 12 is substantially square, whereas, in FIG. 5, the first plate 12 is elongated rectangular shaped. Also, as shown in FIG. 5, it is anticipated the first plate 12 will support other items, such as, but not limited to, decorations, bowls and plates of food, beverage containers, or the like.

Each slot 16 of a set of slots 16 extends into the first plate 12 from a perimeter 18 of the first plate 12. A terminus 20 of the slot 16, which is distal from the perimeter 18 of the first plate 12, may be arcuate so that the terminus 20 complements a cross-sectional profile 22 of a stem 24 of a respective article of stemware 26. The present invention anticipates the set of slots 16 comprising from two to sixteen slots 16, as may be desired for tables 14 seating from two to eight individuals. For example, as shown in FIG. 4, the set of slots 16 comprises eight slots 16, which are positioned two-apiece in each side 28 of the first plate 12. The stemware retention device 10, thus configured, would complement a table 14 that is square and which can seat four individuals, with each individual having ready access to two slots 16, perhaps for one article of stemware 26 having red wine and another article of stemware 26 having white wine. This configuration also would complement a table 14 that is larger, square, and intended to seat two individuals along each edge 30, with each individual having ready access to one slot 16.

A spacing element 32 is attached to and extends from a lower face 34 of the first plate 12. The spacing element 32 may comprise a second plate 36, which is circumferentially smaller than the first plate 12, or other spacing means, such as, but not limited to, discs, posts, or the like. The spacing element 32 is configured to support the first plate 12 above a substantially horizontal surface, such as a top 38 of table 14, as shown in FIG. 5.

A plurality of panels 40 is attached to the lower face 34 of the first plate 12 so that each slot 16 is bracketed by a pair 42 of panels 40. Each panel 40 extends from the first plate 12 to proximate to the substantially horizontal surface. The panels 40, which comprise rubber, silicone, or elastomer, are resiliently flexible so that each pair 42 of panels 40 is configured to engage a base 44 of a respective article of stemware 26 as a stem 24 of the respective article of stemware 26 is inserted into a respective slot 16. Thus, tipping of the respective article of stemware 26 relative to the substantially horizontal surface is inhibited.

The present invention also anticipates a third plate 46, which is attached to the second plate 36 so that the second plate 36 is bracketed by the third plate 46 and the first plate 12. The third plate 46 is circumferentially larger than the first plate 12 and is configured to be positioned on the substantially horizontal surface, thereby increasing stability of the stemware retention device 10. As shown in FIG. 2, the third plate 46 is shaped complementarily to the first plate 12. A first hole 48, a second hole 50, and a third hole 52 are axially positioned in the first plate 12, the second plate 36, and the third plate 46 respectively, with the second hole 50 being aligned with the first hole 48 and the third hole 52. The first hole 48, the second hole 50, and the third hole 52 are configured for insertion of a post 54 of an umbrella 56. With the substantially horizontal surface comprising a top 38 of a table 14, the umbrella 56 is removably attached to the table 14.

The present invention also anticipates a stemware retention system 58, which comprises an article of stemware 26 and a table 14, upon which a stemware retention device 10, as described in the specification above, is positioned. The article of stemware 26 comprises a stem 24 that extends from a base 44, with the stem 24 being inserted into a respective slot 16 of the stemware retention device 10 and the base 44 being engaged to a respective pair 42 of panels 40 of the stemware retention device 10. Thus, tipping of the article of stemware 26 relative to a top 38 of the table 14 is inhibited.

The stemware retention system 58 also may include an umbrella 56, which comprises a post 54. A first hole 48, a second hole 50, a third hole 52, and a post hole 60, are axially positioned in the first plate 12, the second plate 36, the third plate 46, and the table 14, respectively. The post 54 is positioned through the first hole 48, the second hole 50, the third hole 52, and the post hole 60, so that the umbrella 56 is removably attached to the table 14.

In use, the stemware retention device 10 is placed upon a top 38 of a table 14. When serving beverages, such as wine, in stemware 26, users can insert the stems 24 of their stemware 26 into the slots 16 so that the stemware 26 does not tip relative to the table 14, as may occur with minor bumping of the table 14 or the stemware 26, exposure to wind, or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stemware retention device comprising:

a first plate, the first plate being substantially planar;

a set of slots, each slot of the set of slots extending into the first plate from a perimeter of the first plate;

a spacing element attached to and extending from a lower face of the first plate, wherein the spacing element is configured for supporting the first plate above a substantially horizontal surface, wherein the spacing element comprises a second plate, the second plate being circumferentially smaller than the first plate;

a plurality of panels attached to the lower face of the first plate, such that each slot of the set of slots is bracketed by a corresponding pair of panels from the plurality of panels, each panel of the plurality of panels extending from the first plate to proximate to the substantially horizontal surface, the panels of the plurality of panels being resiliently flexible, wherein each pair of panels is configured for engaging a base of a respective article of stemware as a stem of the respective article of stemware is inserted into a respective slot, such that tipping of the respective article of stemware relative to the substantially horizontal surface is inhibited;

a third plate attached to the second plate, such that the second plate is bracketed by the third plate and the first plate, the third plate being circumferentially larger than the first plate, wherein the third plate is configured for positioning on the substantially horizontal surface;

a first hole axially positioned in the first plate;

a second hole axially positioned in the second plate such that the second hole is aligned with the first hole, wherein the first hole and the second hole are configured for insertion of a post of an umbrella; and a third hole axially positioned in the third plate, such that the third hole is aligned with the first hole and the second hole, wherein the first hole, the second hole, and the third hole are configured for insertion of a post of an umbrella.

2. The stemware retention device of claim 1, wherein the first plate is one of rectangular, square, hexagonal, octagonal, circular, or ovoid.

3. The stemware retention device of claim 1, wherein a terminus of the slot distal from the perimeter of the first plate is arcuate, such that the terminus is configured to complement a cross-sectional profile of the stem of the respective article of stemware.

4. The stemware retention device of claim 1, further including:

a first hole axially positioned in the first plate; and a second hole axially positioned in the second plate such that the second hole is aligned with the first hole, wherein the first hole and the second hole are configured for insertion of a post of an umbrella.

5. The stemware retention device of claim 1, wherein the panels of the plurality of panels comprise rubber, silicone, or elastomer.

6. The stemware retention device of claim 1, wherein the third plate is shaped complementarily to the first plate.

7. A stemware retention device comprising:

a first plate, the first plate being substantially planar, the first plate being one of rectangular, square, hexagonal, octagonal, circular, or ovoid;

a set of slots, each slot of the set of slots extending into the first plate from a perimeter of the first plate, a terminus of the slot distal from the perimeter of the first plate being arcuate, such that the terminus complements a cross-sectional profile of a stem of a respective article of stemware;

a spacing element attached to and extending from a lower face of the first plate, wherein the spacing element is configured for supporting the first plate above a substantially horizontal surface, the spacing element comprising a second plate, the second plate being circumferentially smaller than the first plate;

a first hole axially positioned in the first plate;

a second hole axially positioned in the second plate such that the second hole is aligned with the first hole, wherein the first hole and the second hole are configured for insertion of a post of an umbrella;

a plurality of panels attached to the lower face of the first plate, such that each slot of the set of slots is bracketed by a pair of panels, each panel of the plurality of panels extending from the first plate to proximate to the substantially horizontal surface, the panels of the plurality of panels being resiliently flexible, wherein each pair of panels is configured for engaging a base of the respective article of stemware as the stem of the respective article of stemware is inserted into a respective slot, such that tipping of the respective article of stemware relative to the substantially horizontal surface is inhibited, the panels of the plurality of panels comprising rubber, silicone, or elastomer;

a third plate attached to the second plate, such that the second plate is bracketed by the third plate and the first plate, the third plate being circumferentially larger than the first plate, wherein the third plate is configured for positioning on the substantially horizontal surface, each panel of the plurality of panels extending from the first plate to proximate to the third plate, the third plate being shaped complementarily to the first plate; and a third hole axially positioned in the third plate, such that the third hole is aligned with the first hole and the second hole, wherein the first hole, the second hole, and the third hole are configured for insertion of the post of the umbrella.

8. A stemware retention system comprising:

a table;

a first plate, the first plate being substantially planar;

a set of slots each slot of the set of slots extending into the first plate from a perimeter of the first plate;

a second plate attached to and extending from a lower face of the first plate, the second plate being circumferentially smaller than the first plate;

a third plate attached to the second plate, such that the second plate is bracketed by the third plate and the first plate, the third plate being circumferentially larger than the first plate, the third plate being positioned on a top of the table;

a plurality of panels attached to the lower face of the first plate, such that each slot of the set of slots is bracketed by a pair of panels, each panel of the plurality of panels extending from the first plate to proximate to the third plate, the panels of the plurality of panels being resiliently flexible;

an article of stemware having a stem extending from a base, the stem being inserted into a respective slot, such that the base of the article of stemware is engaged to a respective pair of panels, such that tipping of the article of stemware relative to the top of the table is inhibited;

a first hole axially positioned in the first plate;

a second hole axially positioned in the second plate, such that the second hole is aligned with the first hole;

a third hole axially positioned in the third plate, such that the third hole is aligned with the first hole and the second hole;

a post hole axially positioned in the table, such that the post hole is aligned with the first hole, the second hole, and the third hole; and an umbrella comprising a post, the post being positioned through the first hole, the second hole, the third hole, and the post hole, such that the umbrella is removably attached to the table.

* * * * *